United States Patent [19]

Bayless

[11] 4,060,748

[45] Nov. 29, 1977

[54] SURFACE BREAKDOWN IGNITER FOR MERCURY ARC DEVICES

[75] Inventor: John R. Bayless, Malibu, Calif.

[73] Assignee: Hughes Aircraft Company, Culver City, Calif.

[21] Appl. No.: 707,976

[22] Filed: July 23, 1976

[51] Int. Cl.[2] ..... H01J 13/06; H01J 13/34; H01T 13/52

[52] U.S. Cl. ..... 313/171; 313/131 A

[58] Field of Search ..... 313/171, 170, 131 A, 313/163

[56] References Cited

U.S. PATENT DOCUMENTS

| | | | |
|---|---|---|---|
| 3,538,375 | 11/1970 | Eckhardt | 313/163 X |
| 3,558,959 | 1/1971 | Ziemendorf | 313/131 A X |
| 3,579,011 | 5/1971 | Hyman | 313/163 X |
| 3,586,904 | 6/1971 | Eckhardt | 313/7 X |
| 3,638,061 | 1/1972 | Lutz et al. | 313/161 |
| 3,659,132 | 4/1972 | Eckhardt | 313/32 |
| 3,662,205 | 5/1972 | Lian | 313/163 X |
| 3,668,453 | 6/1972 | Lian et al. | 313/7 |
| 3,699,384 | 10/1972 | Eckhardt | 313/170 X |

FOREIGN PATENT DOCUMENTS

| | | | |
|---|---|---|---|
| 86,334 | 1/1959 | Denmark | 313/131 A |
| 1,129,629 | 5/1962 | Germany | 313/171 |

*Primary Examiner*—Palmer C. Demeo

*Attorney, Agent, or Firm*—Allen A. Dicke, Jr.; W. H. MacAllister

[57] ABSTRACT

Surface breakdown igniter comprises a semiconductor of medium resistivity which has the arc device cathode as one electrode and has an igniter anode electrode so that when voltage is applied between the electrodes a spark is generated when electrical breakdown occurs over the surface of the semiconductor. The geometry of the igniter anode and cathode electrodes causes the igniter discharge to be forced away from the semiconductor surface.

8 Claims, 3 Drawing Figures

SURFACE BREAKDOWN IGNITER FOR MERCURY ARC DEVICES

The government has rights in this invention pursuant to Contract No. E(49-18)-2149 awarded by the U.S. Energy Research and Development Administration.

BACKGROUND OF THE INVENTION

This invention is directed to a surface breakdown igniter for mercury arc devices, and is an igniter which is particularly useful for liquid metal plasma devices which are repetitively ignited.

Various types of igniter devices have been applied in prior and present day liquid metal arc devices, and particularly mercury arc rectifiers and inverters. In rectifier service conduction must be initiated whenever a forward potential is applied. Since the rectifier does not hold off voltage in the forward direction a keeper anode with a keeper discharge can be employed as long as the plasma does not extend into the anode region. Thus, in rectifier practice keeper anodes have been widely used and highly developed.

On the other hand, in inverter service the liquid metal plasma valve must hold off the voltage until the proper phase angle, and then the plasma is ignited to permit forward conduction. Since forward voltage is applied at all times, a keeper anode cannot very well be employed because the presence of plasma in the cathode region will permit forward conduction at unwanted times. The boron carbide igniter is presently the only type used in liquid metal plasma valves which operate as switches or in inverter service. This type of igniter, which operates on a different principle than the surface breakdown igniter has the following characteristics. The contact pressure between the boron carbide igniter and the liquid metal plasma valve cathode must be mechanically adjustable and therefore a mechanical linkage is required for this adjustment, and a control circuit is required to accomplish the adjustment. Furthermore, provision must be made to control the temperature of the boron carbide igniter independently of the cathode temperature. This provision also necessitates control circuitry since the required igniter temperature is dependent on the liquid metal plasma valve operating parameters. Furthermore, the boron carbide igniter is very complicated. Many more parts and consequent costs are involved in association with the boron carbide igniter. This greater complexity is principally associated with the mechanically moveable parts, and there is additional expense in connection with the controls.

On the other hand, there has been prior activity which employs some form of surface breakdown mechanism but which is not suitable for a liquid metal plasma valve ignition. This prior art includes commercially available igniters used to ignite air-fuel mixtures in jet engines, and the like.

SUMMARY OF THE INVENTION

In order to aid in the understanding of this invention it can be stated in essentially summary form that it is directed to a surface breakdown igniter for mercury arc devices wherein the cathode of the mercury arc device serves as one electrode and is in direct contact with the surface of a medium resistivity semiconductor material and an igniter electrode is in contact with the same surface so that as voltage is applied between the electrodes a surface electrical breakdown occurs to produce a spark and the spark is forced away from the semiconductor surface into the active region of the arc device.

It is thus an object of this invention to provide a surface breakdown igniter for the ignition of liquid metal arc devices, so that a spark for plasma ignition is produced by electrical breakdown over the surface of the medium resistivity semiconductor. It is a further object to provide an igniter for liquid metal arc devices which is of reliable nature so that ignition is reliably achieved. It is a further object to provide an igniter of such nature as to provide long life by positioning the semiconductor surface to be protected from the main plasma arc, to be protected from sputtering and is designed so that the ignition spark is forced away from the surface to reduce erosion. It is another object to provide an igniter which has a cathode electrode which is part of the liquid metal plasma valve cathode so that the liquid metal film which covers the active area of the liquid metal plasma valve cathode also extends to the junction of the semiconductor igniter with the cathode.

Other objects and advantages of this invention will become apparant from the study of the following portion of the specification, the claims and the attached drawings.

DESCRIPTION

Figure 1:
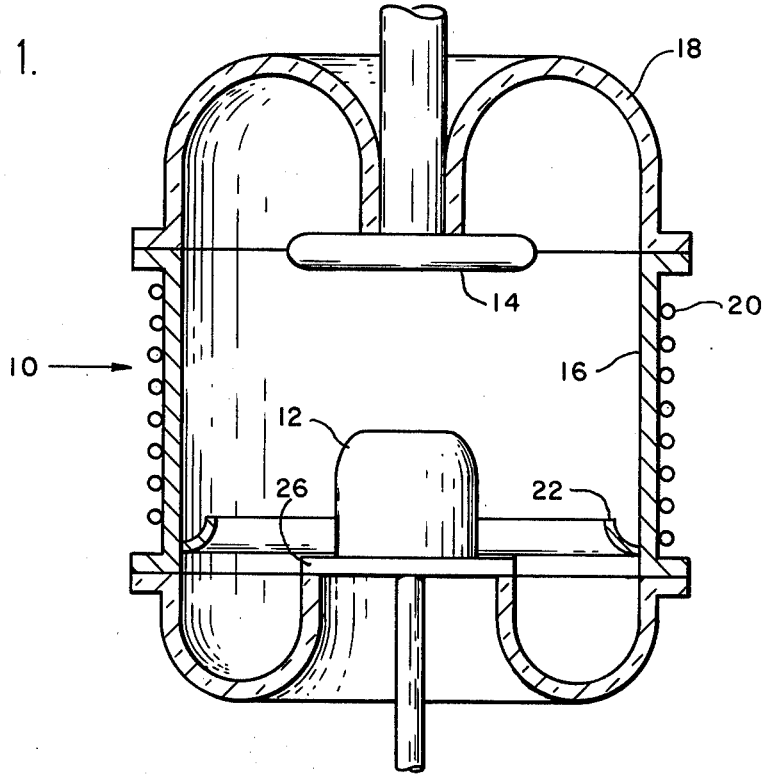
FIG. 1 is a section through the center line of a liquid metal plasma valve.

FIG. 1 illustrates liquid metal plasma valve 10. This plasma valve is described in more detail in W. O. Eckhardt U.S. Pat. No. 3,659,132. It comprises cathode 12 and anode 14 together with a condensing surface 16. These are combined within envelope or housing 18. Condenser 16 is shown as being part of the housing wall with cooling coils 20 in thermal engagement with the metallic central part of the housing. Gutter 22 collects liquid metal which has been condensed out of the interelectrode space. In addition to the above-identified patent, similar liquid metal plasma valves are shown in the following patents: U.S. Pat. Nos. 3,638,061; 3,662,205; 3,668,453; 3,586,904; 3,538,375; 3,579,011; 3,699,384. These patents illustrate various embodiments of liquid metal plasma valves into which the present surface breakdown igniter can be installed and employed for ignition. The disclosures of these patents are incorporated herein in their entirety.

Figure 2:
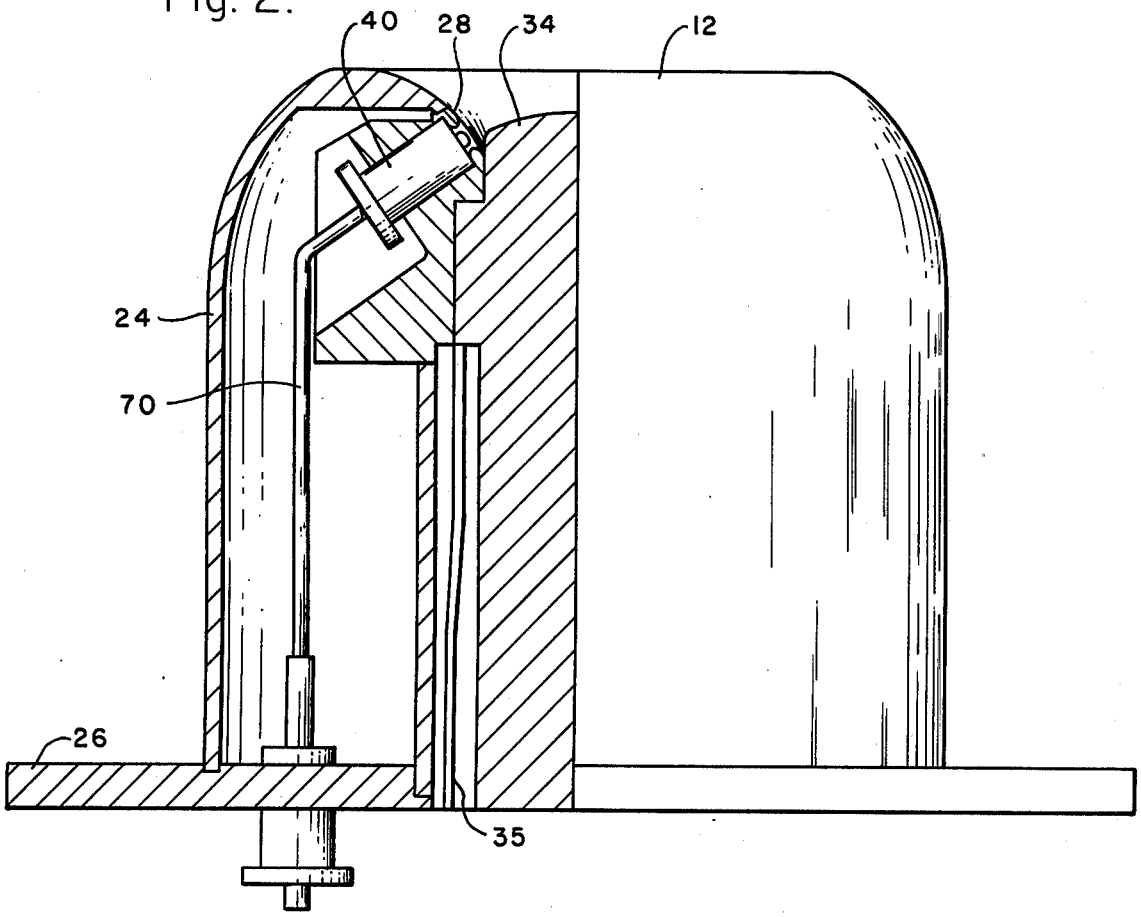
FIG. 2 is a partial section through the cathode of the liquid metal plasma valve, with parts taken in section and parts broken away.

Cathode 12 is shown in more detail in FIG. 2 where outer shell 24 is attached to flange 26 at its bottom and extends upward to outer structure 28. Outer structure 28 is shown on even further enlarged detail in FIG. 3 where pool-keeping walls 30 and 32 define an annular recess between the outer structure and center plug 34.

As is disclosed in more detail in the above-listed patents, liquid metal is fed through tube 35 to the recess between the pool-keeping walls and when interelectrode potential is applied and ignition is achieved, an arc runs on the liquid metal surface at a juncture with the pool-keeping walls so that electrical conduction occurs. Igniter 40 is designed and positioned to achieve the required ignition.

Outer structure 28 extends continuously down pool-keeping wall 30 and is electrically connected as part of the cathode 12 of liquid metal plasma valve 10. It has bore 42 therein which serves to receive igniter 40. Wall 44 is in the front of the bore and serves as a stop for the igniter as it is inserted. An opening in pool-keeping wall 30 is defined by nose wall 46 which is formed as a part torus, shaped to be bulbous between walls 30 and 44.

Body 48 is cylindrically tubular and fits within bore 42 and up against wall 44. It is made of material which is of high thermal conductivity such as copper and fits tightly in bore 42. Wedging the body into the bore is accomplished by expander screws, two of which are shown at 50 and 52. The expander screws are screwed down into conical threaded holes 54 and 56 respectively to expand the outer surface of body 48 into tight thermal engagement in bore 42. Structure 28 is appropriately thermally controlled, by cooling as necessary to remove the heat of the arcing process so that by this construction the igniter is cooled by rejecting heat to the thermally controlled structure 28.

Semiconductor block 58 is tubular with a cylindrical interior surface 60 and a truncated conical exterior surface 62. The exterior surface 62 seats against the similar truncated conical surface in the front of body 48 and the semiconductor block 58 is brazed to body 48 along that joined surface. The semiconductor block is silicon carbide, while the body 48 is copper. Front surface 64 of semiconductor block 58 engages against the underside of outer structure 28 on wall 44 so that it joins with the outer structure at the curve of wall 46.

Igniter anode 66 is domed and has shank 68 extending into the interior opening in the semiconductor block. It is secured in the semiconductor block by brazing. Anode lead 70 is secured to igniter anode 66 and extends out of the cathode for separate connection, as shown in FIG. 2. The nose of igniter anode 66 is flat on the end and cylindrical on the outside, with a radiused corner to form a gap with respect to nose wall 46. Both outer structure 28 and igniter anode 66 are of refractory metal, such as molybdenum, which resists erosion.

The shape of the two electrodes at the igniter gap above the front surface of the semiconductor block is such as to cause the igniter discharge to be forced away from the semiconductor surface and into the active region of the liquid metal plasma valve cathode, into the channel or groove between the pool-keeping walls 30 and 32. This helps reduce the erosion of the semiconductor and allows the ignition spark to be initiated at a point remote from the main plasma valve discharge. The large semiconductor surface area of front surface 64 increases that portion of the lifetime which is determined by semiconductor erosion by providing a large amount of available material. The front surface 64 is shielded from sputtering which might result from the main discharge between cathode 12 and anode 14. A mercury film covers the active area of the cathode including the pool-keeping walls 30 and 32 and this mercury film extends to the junction of wall 46 with the front surface 64 of semiconductor block 58. This prolongs cathode life because mercury rather than cathode material is eroded from wall 46 and helps to avoid sputter deposition of igniter cathode material onto the semiconductor surface 64.

Tests show high reliability, equal to or greater than 99.9% ignition under a wide variety of liquid metal plasma valve operating conditions. With three igniters and with each igniter having a reliability as low as 99.9%, then the probability of a misfire will be $1 \times 10^{-9}$, or one misfire every 6 months at 60 Hz. In addition, the surface breakdown igniter 40 of this invention has inherent reliability associated with its simplicity.

The mechanism of the surface breakdown igniter is based on the empirical observation that reliable discharges can be obtained with gap widths of 0.075 to 0.125 cm over the surface of a medium resistivity semiconductor at voltages of about 1000 volts. Similar results are obtained whether air or vacuum is present above the semiconductor surface. If a high resistivity semiconductor is used, the breakdown is similar to that obtained with an insulator, i.e., the breakdown voltage is much higher and less predictable from shot to shot. If a low resistivity semiconductor is used, then the current is simply conducted through the bulk of the material. The breakdown characteristics are different in the case of a surface breakdown igniter which operates in a mercury vapor environment. Initially, the igniter resistance and breakdown voltage are high and the breakdown voltage increases with gap width. After conditioning with an operating liquid metal plasma valve for about one hour at 60 Hz, the resistance drops to typically 1 to 100 ohms depending on the liquid metal plasma valve operating conditions. This is much lower than encountered in other applications. Furthermore, the breakdown voltage drops to a value as low as 150 volts and appears to be independent of gap width. Although a physical mechanism for these results is still not postulated, it does appear that small mercury droplets collect on the semiconductor surface thereby influencing operation and reducing the surface breakdown igniter electrical resistance. Since the semiconductor surface 64 is not wetted by mercury, a continuous high conductivity film which would impair operation is not formed.

Figure 3:
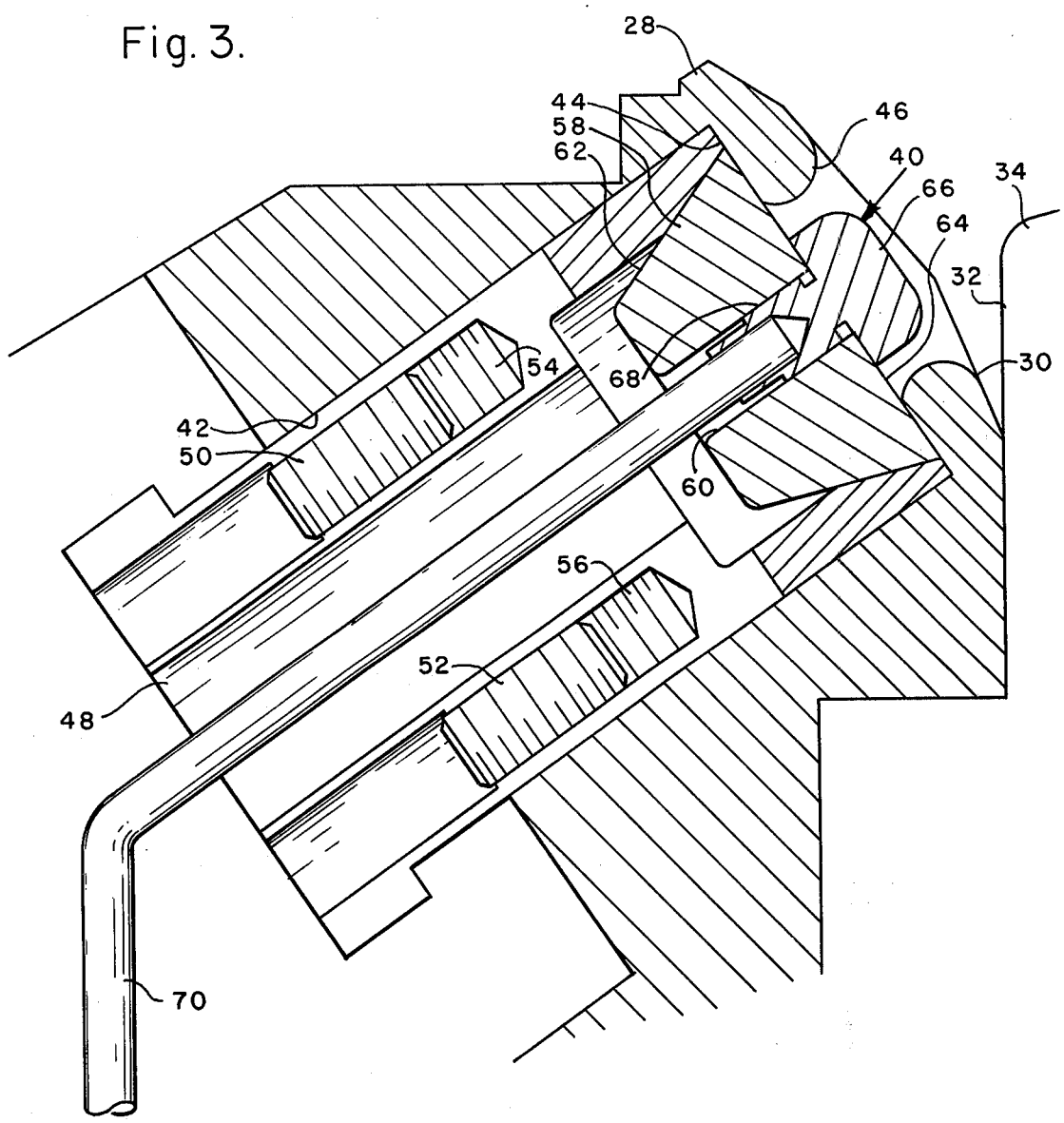
FIG. 3 is a further enlarged section through the igniter of this invention and through the adjacent portions of the liquid metal plasma valve cathode.

Particular design characteristics make it well suited to long life operation in a liquid metal plasma valve. FIG. 3 particularly illustrates electrode geometry which achieves a condition in which the discharge that initially occurs over the surface 64 of semiconductor 58 will be forced to leave that surface and be expelled into the main liquid metal plasma valve discharge region above the pool. This is desirable in order to reduce erosion of the semiconductor surface and to promote coupling between the geometrically isolated surface 64 and the main liquid metal plasma valve discharge region. This is accomplished in two ways. First, the surface breakdown anode and cathode are shaped such that the interelectrode separation decreases away from the semiconductor surface 64. Discharge stability criteria dictate that the igniter arc will move to a location resulting in a minimum discharge voltage which is the location of the minimum gap width. Second, the coaxial geometry results in a $j \times B$ force which forces the arc plasma into the main liquid metal plasma valve discharge region.

The large semiconductor surface 64 is desirable in order to provide a large volume of material which can be eroded without causing igniter malfunction, and thus produce a long life. Good sputter shielding and geometrical isolation from the main liquid metal plasma valve discharge is achieved. This results in minimizing deposition of material sputtered by the main discharge and insures that the high current main discharge does not become localized in the igniter region. This is achieved because the igniter recess access is not directed toward the main anode 14 and because of the recessed position of semiconductor surface 64 between its electrodes. This recess results in a high local discharge voltage as far as the main discharge is concerned, thereby causing the main discharge to move elsewhere on the mercury film which covers the cathode surface.

Continuity of the surface between main cathode wall 30 and wall 46 permits the mercury film which covers the liquid metal plasma valve cathode walls 30 and 32 to extend up to wall 46 and to the juncture with surface 64. Continuity of the surface insures continuity of the mercury film. Under these circumstances it will be the mercury film rather than the molybdenum substrate which will be eroded by the ignition of arcs. This means that wall 46 which serves as the cathode electrode of the igniter is constructed of the same good refractory metal, such as molybdenum. Igniter anode 66 is constructed of the same material.

Semiconductor block 58 is constructed of commercial silicon carbide, and an example of specific material is Ceralloy 146-I purchased from Ceradayne. It has a resistivity of $10^3$–$10^5$ ohm.centimeters. This material is chosen because of its high thermal shock resistance, electrical resistivity and availability. Other semiconductors may offer lower erosion rates but may not offer significant advantages in the present use. The shape of the inactive surface of the semiconductor is such as to provide a sufficiently long path that will assure that the discharge does not form along it.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. An igniter for a liquid metal plasma valve having an anode, a cathode and a condenser in an envelope so that a low pressure plasma arc discharge can operate between the cathode and anode and the atoms can be condensed out on the condenser;

said cathode having a pool-keeping wall for defining a liquid metal pool on which an arc runs to form the plasma discharge, an opening in said pool-keeping wall, said opening being defined by an igniter cathode wall which is continuous with said pool-keeping wall;

a block of semiconductor material having a front surface positioned in said opening with said front surface in engagement with said igniter cathode wall and below said pool-keeping wall; and an igniter anode engaging said surface of said block of semiconductor material, said igniter anode being spaced from said igniter cathode so that upon application of voltage between said igniter anode and said igniter cathode a surface breakdown arc occurs across the front surface of said semiconductor material for igniting a plasma arc between said anode and said cathode of said liquid metal plasma valve.

2. The liquid metal plasma valve of claim 1 wherein said igniter anode is centrally located on said front surface of said block of semiconductor material to define an annular exposed front surface for surface breakdown arcing.

3. The liquid metal plasma valve of claim 2 wherein at least one of said igniter anode and said igniter cathode has a convex, bulbus nose so that the shortest distance between said igniter anode and said igniter cathode is away from said front surface of said block of semiconductor material so that surface breakdown arcing moves away from said front surface toward a location where said igniter anode and said igniter cathode are at minimum spacing.

4. The liquid metal plasma valve of claim 3 wherein said opening in said liquid metal plasma valve cathode wall forming said igniter cathode is defined by a convex wall.

5. The liquid metal plasma valve of claim 2 wherein said block of semiconductor material is mounted in a body and said body is mounted in said liquid metal plasma valve cathode below said opening in said cathode wall, to retain said block of semiconductor material in place.

6. The liquid metal plasma valve of claim 5 wherein said block of semiconductor material has a central opening therein and said anode is mounted in said central opening, and an anode lead is connected to said igniter anode through said central opening and through said mounting body.

7. An igniter comprising:

an igniter cathode electrode body having an opening therein and an igniter anode electrode in said opening in said igniter cathode electrode to define an annular space therebetween;

a block of semiconductor material have a front surface, said block of semiconductor material being mounted in said opening, said block of semiconductor marterial having an opening therein, said anode electrode being mounted over said opening in said block of semiconductor material and engaging the front surface thereof, one of said electrodes being convex so that the annular space between said electrodes is shorter away from said surface of said semiconductor block that at said surface of said semiconductor block so that upon application of a voltage between said electrodes an arc occurs on said surface of said semiconductor material and is transferred away from said surface toward the narrower interelectrode space; and an anode lead connected to said igniter anode through said opening in said block and said opening in said body.

8. The igniter of claim 7 further including means on said body for expanding said body for thermal contact.

* * * * *